US011173586B2

(12) United States Patent
Sebree

(10) Patent No.: US 11,173,586 B2
(45) Date of Patent: Nov. 16, 2021

(54) DISENGAGING SOCKET EXTENSION

(71) Applicant: Honda Motor Co., Ltd., Tokyo (JP)

(72) Inventor: Jared Daniel Sebree, Franklin, IN (US)

(73) Assignee: Honda Motor Co., Ltd., Tokyo (JP)

( * ) Notice: Subject to any disclaimer, the term of this patent is extended or adjusted under 35 U.S.C. 154(b) by 317 days.

(21) Appl. No.: 16/524,400

(22) Filed: Jul. 29, 2019

(65) Prior Publication Data

US 2021/0031340 A1 Feb. 4, 2021

(51) Int. Cl.
*B25B 23/00* (2006.01)
*B25B 21/00* (2006.01)

(52) U.S. Cl.
CPC ..... *B25B 23/0007* (2013.01); *B25B 21/00* (2013.01); *B25B 23/0035* (2013.01)

(58) Field of Classification Search
CPC . B25B 23/0007; B25B 23/0035; B25B 21/00; B25B 21/002
See application file for complete search history.

(56) References Cited

U.S. PATENT DOCUMENTS 2,750,828 A 6/1956 Wendling
6,263,766 B1 * 7/2001 Jarvis ..... B25B 23/0021 81/177.2
7,363,839 B2 4/2008 Chiang
8,250,949 B2 8/2012 Hu
8,424,423 B2 * 4/2013 Su ..... B25B 23/0014 81/177.85
9,138,887 B2 * 9/2015 Su ..... B25B 23/0007
9,884,413 B2 * 2/2018 Patterson ..... B25B 23/0021
2003/0056625 A1 3/2003 Bizilia et al.
2005/0235785 A1 10/2005 Chang
2009/0133543 A1 5/2009 Diehl et al.
2014/0311302 A1 10/2014 Taguchi et al.
2016/0263732 A1 9/2016 Lourenco et al.
2020/0055168 A1 * 2/2020 Kuo ..... B25B 23/0007

FOREIGN PATENT DOCUMENTS

DE 3338217 A1 5/1985
DE 102007030511 A1 3/2008
FR 2983425 A1 6/2013
WO 2018106976 A1 6/2018

* cited by examiner

*Primary Examiner* — David B. Thomas
(74) *Attorney, Agent, or Firm* — Plumsea Law Group, LLC

(57) ABSTRACT

A socket extension assembly adapted to be driven by a power tool is disclosed. The shell surrounds a connector and drive subassembly that are fixedly attached to one another and in axial alignment. A biasing member is interposed between the shell and subassembly to provide disengagement of the drive and shell in a natural state, and engagement and transmission of rotation when axial force is applied to mate the drive and shell. This enables a fastener to be loaded into the socket as usual and hand-started while the fastener is already loaded into the socket. After confirmation that the threads are properly and sufficiently aligned and engaged into the mating threads, the fastening process can be completed by applying axial pressure to transmit the rotational force from the power tool via the bit and the drive to the socket stem.

20 Claims, 2 Drawing Sheets

DISENGAGING SOCKET EXTENSION

BACKGROUND OF THE INVENTION

The present invention relates to a socket extension that selectively couples a drive mechanism to a socket upon application of axial force.

Rotatable driving tools such as sockets have a wide variety of application and utility. A simple socket is generally cylindrical and is coupled to a turning tool or driving mechanism at one end and engages a fastener at the opposite end in order to tighten or loosen the fastener. The turning tool or driving mechanism may be a hand tool such as a socket wrench or a ratchet, or may be a power tool such as a power drill or impact drive. With power tools such as an electric drill or an impact wrench, higher speed and torque are applied to the fastener which can greatly speed up the process, whether it be assembly or disassembly. Depending on the material into which the fastener is being applied, higher speed and torque, especially when applied suddenly, may cause deformation, damage to the threads or incomplete attachment of the fastener. This has been found to be particularly true when applying fasteners into relatively softer materials such as aluminum-based metals, plastics or relatively weaker materials. In these instances, the fastener is typically started by hand by the operator before a power tool can be employed. This requires separate process steps of hand-starting the fastener, and then applying the socket with a power tool. Fasteners that thread into aluminum must be hand-started to ensure proper alignment and thread engagement. Hand-starting requires an extra process and thus extra process time.

Currently, when applying fasteners to softer materials such as aluminum, an operator must first grasp the fastener by hand and hand-start to ensure engagement of the threaded fastener into the mating threaded hole by at least about three threads. Once this minimum number of threads are engaged, a power tool is applied to drive the fastener completely to full torque.

SUMMARY OF THE INVENTION

The device disclosed bypasses the need to finger-start a fastener and enables an operator to engage the fastener to the socket tool from the start. The present disclosure provides a socket extension that allows the fastener to be loaded into the socket tool as usual and hand-start the fastener while the fastener is already loaded into the socket. After confirmation that the threads are properly and sufficiently aligned and engaged into the mating threads, the fastening process can be completed by applying axial pressure to engage the drive of the power tool. Both the hand-start and the turning are achieved after the single process step of loading the fastener into the socket extension.

In one aspect of the invention, a socket extension assembly comprises a socket shell with a drive stem on one end and defining an inner sleeve with an opposite open end. Integrally formed within the sleeve is a drive seat. The assembly also includes a tool having a tool bit at one end that engages a fastener and a drive end that is configured to mate with the drive seat. A connector is provided within the sleeve and is fixedly attached to the tool to form a connector and tool subassembly. This subassembly is rotatably received in the socket sleeve and in axial alignment. The connector has a length that is shorter than the length of the sleeve to enable it to move axially therein. The socket extension assembly also includes a biasing member placed in the sleeve between the connector and the drive stem end of the shell to maintain disengagement of the drive end of the tool from the drive seat in the shell. Sufficient axial force must be applied between the tool and shell to overcome the biasing member and cause full engagement and mating of the drive end of the tool with the drive seat in the sleeve. Once these drive elements are mated together, rotation motion is transmitted from the drive stem of the shell to the tool bit.

Until the drive elements are mated together, the connector and tool subassembly is independently rotatable with respect to the socket shell to enable an operator to hand-start fasteners by twisting the tool.

In another aspect, the connector may be a cylindrical bushing having a central portion of reduced internal diameter and open ends of larger internal diameter to receive bearing at each end thereof for fixed attachment of the tool. The connector may also include retaining structures attaching the bearings onto the bushing.

The biasing member may be a compressible element such as a wave spring having a natural state of keeping the drive end disengaged from the drive seat.

The assembly may also include a retaining structure on open end of the socket shell that surrounds the tool and maintains axial alignment of the tool, connector and shell. The retaining structure may include an annular internal recess in the shell receiving a retaining clip therein.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
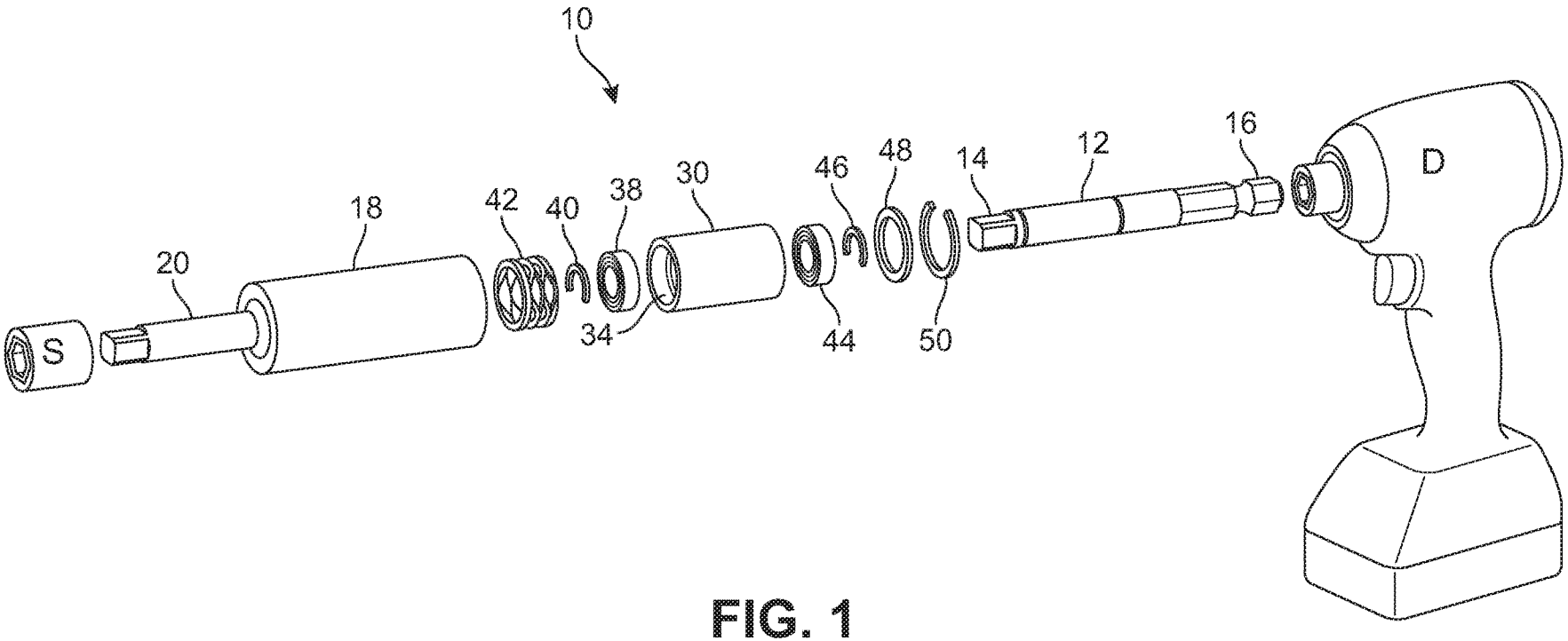
FIG. 1 is an exploded perspective view of an embodiment of the socket extension assembly.
Figure 2:
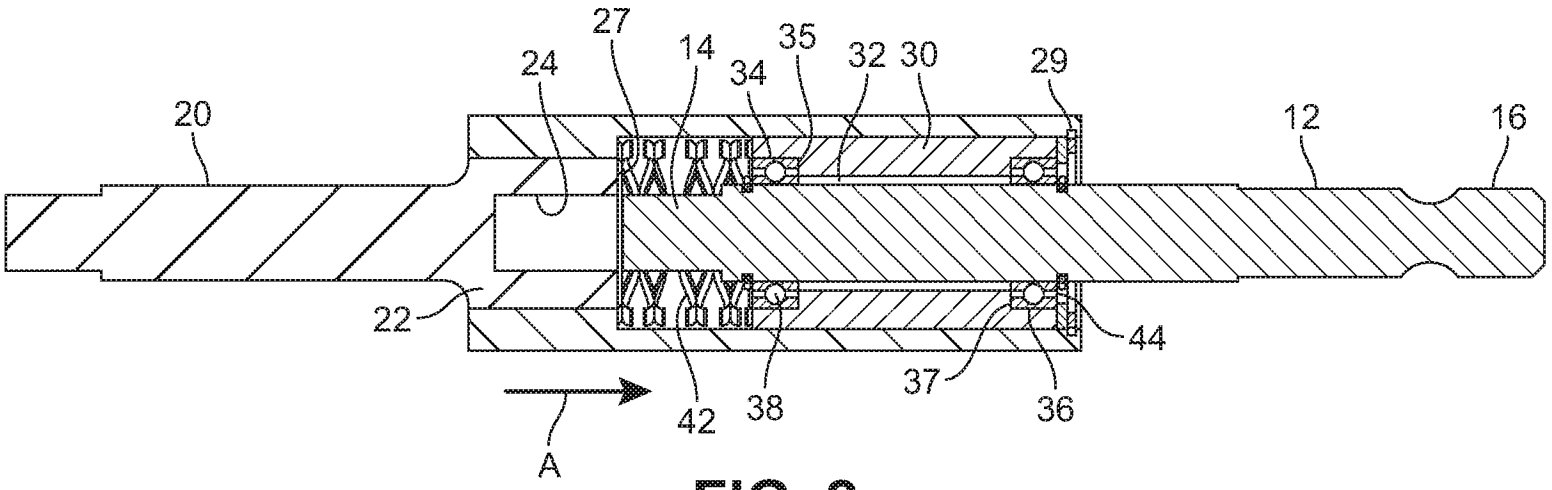
FIG. 2 is a cross section of the socket extension assembly shown in the extended, disengaged state.
Figure 3:
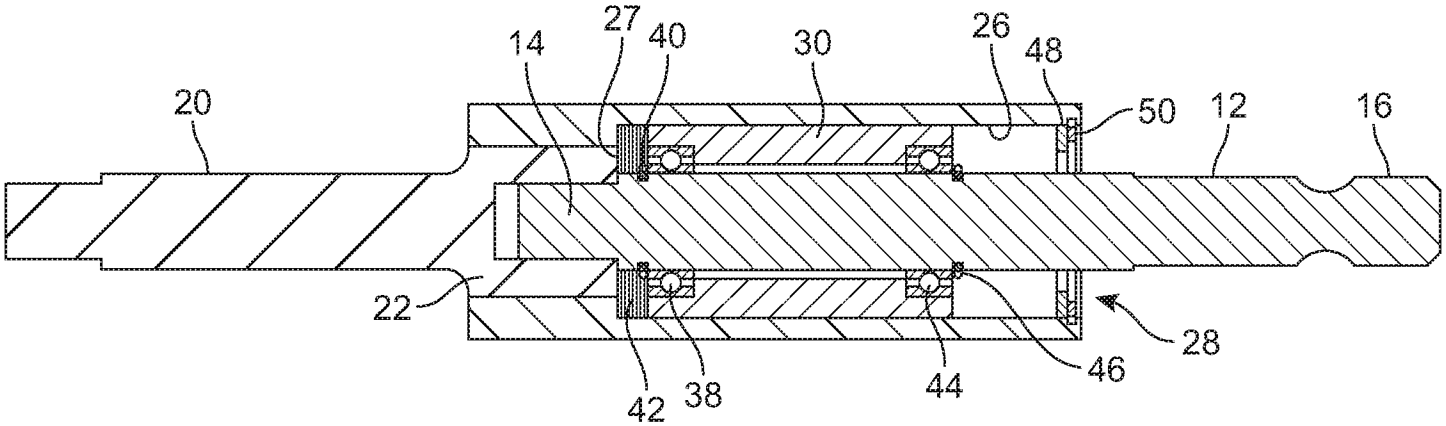
FIG. 3 is a cross section of the socket extension assembly shown in the retracted, engaged state.

Referring to FIGS. 1-3, socket extension assembly 10 is shown in an exploded view in FIG. 1, and in cross section in FIGS. 2 and 3 in two different states. Broadly, socket extension assembly 10 comprises a drive 12 having a drive end 14 and a drive bit 16. Drive bit 16 is adapted to engage with a power drill or an impact machine via a hex drive, for example. Assembly 10 also includes a socket shell 18 defining a sleeve and having a socket stem 20 extending therefrom. Inside socket shell 18 are an inner bushing 30 and fixing elements to retain a drive 12 in axial alignment. For illustration purposes, in FIG. 1, on the machine side, a power drill D is shown in alignment with the hex drive bit 16, and on the working side, a sample socket S is shown in alignment with socket stem 20. While drive bit 16 is illustrated as a hex bit, it could be of any geometry that fits the machine's chuck. As seen in the figures, drive 12 comprises a drive stem 14 and an integral bit 16. For simplicity, since the figures illustrate the socket extension oriented from the socket end on the left to the bit or machine end on the right, directional references may be made with respect to this orientation. Toward the socket side means toward the left in the figures, and toward the machine or bit side means toward the right in the figures. It will be understood that these directional adjectives apply to the illustrations, and that the assembly may be in different orientations while in use. In the illustrated embodiment, drive stem 14 is shown as a square drive, and bit 16 is shown as a hex bit that will mate to the chuck of drill D. It will be understood that these geometries may be any mating types.

Socket shell 18 is generally cylindrical and has fixed on one end a socket stem 20. The opposite end is open to receive drive 12. Socket stem 20 of the socket extension assembly has a base 22 fixedly attached to shell 18 as best seen in FIGS. 2 and 3. Socket base 22 defines a seat 24 that is a female mating element that opens toward the open end of the shell. Seat 24 is configured to mate with a drive stem such as male drive stem 14 of drive 12. The portion of the shell onto which the base is attached has a reduced diameter compared to the remainder of sleeve 26. The reduced diameter portion and the end of base 22 form an internal shoulder 27 that faces open end 28 of sleeve 26. Shoulder 27 provides an abutment surface for internal components of the socket extension assembly. Similarly, at the open end of sleeve 26, an annular recess 29 is provided adjacent the opening.

The internal components of the socket extension assembly include a cylindrical bushing 30 having a central portion 32 that is narrowed by virtue of a reduced internal diameter as compared to a drive side end 34 and a tool side end 36 having larger internal diameters so as to each provide a shoulder 35 and 37, respectively, on the inner surface of the bushing. Seated inside the bushing are a socket side bearing 38 and clip 40 that bear against bushing shoulder 35. Disposed within sleeve 26 and between shoulder 27 and bushing 30 is a spring 42. On the opposite end of the bushing are a drive side bearing 44 seated on shoulder 37 held in place by clip 46. A washer 48 and a retaining ring 50 are attached at the free end 28 of shell 18 such that ring 50 is received in annular recess 29 to thereby enclose opening 28. These internal components axially receive drive 12 and maintain axial alignment of drive 12 with shell 18, and thereby socket stem 20. Clips 40 and 46 fixedly attach the stem of drive 12 to bushing 30. As seen in FIGS. 2 and 3, bushing 30 has a length that is shorter than the length of sleeve 26 between shoulder 27 and opening 28. This enables bushing 30, and consequently drive 12, to move axially between an extended position, FIG. 2, and a retracted position, FIG. 3.

In the extended position, FIG. 2, spring 42 is in its natural, uncompressed state, and bushing 30 is closer to opening 28. When spring 42 is uncompressed, male drive stem 14 of drive 12 is disengaged from female seat 24. Therefore, socket stem 20 and socket shell 18 are free to rotate independently relative to drive 12. Spring 42 biases drive 12 into a disengaged state. This is what enables finger-start of the socket by rotating the socket shell. In the compressed position, FIG. 3, it can been seen that spring 42 is compressed and bushing 30 is closer to shoulder 27 so that male drive stem 14 is engaged and seated in female seat 24 of shell 18. In the compressed or engaged position, when drive 12 is rotated by application of a power tool D, socket stem 20 is also rotated as they are engaged and connected via drive stem 14 being matingly seated in seat 24. The axial force necessary to compress spring 42 to bring bushing 30 closer to shoulder 27, and thereby force male drive stem 14 to be seated in female seat 24 is a matter of design choice depending on the material that the tool is applied to, the material of the fastener and other parameters in the manufacturing or assembly environment. The amount of force can be thought of as sufficient force to overcome the spring force and require its compression into the state shown in FIG. 3.

In the illustrated embodiment, male drive stem 14 is a square drive mating to female seat 24 which has a corresponding, mating geometry. This is just one possible configuration, and it is understood that the relative sizes of the drive stem and any mating member may vary from one another. In the illustrated embodiment, less than 90 degrees of rotation of male drive stem 14 relative to female seat 24 when axial pressure is applied in the direction of arrow A will be sufficient to engage and seat the drive end in the drive seat. The mating surfaces of drive end 14 and drive seat 24 may be configured for biasing engagement of the two such as providing sloped surfaces or the like.

While the illustrated embodiment depicts a male drive stem 14 of a drive 12 engaged into a female seat 24 in the socket shell 18 it will be understood that the geometry could vary such that the socket shell includes a male mating member while the drive 12 has a drive end that is a female mating member. Any mating geometries will be understood to be within the scope of the disclosure.

In the illustrated embodiment, while spring 42 is shown as a single wave spring member, it is understood that any number of springs or spring components may be used of varying types to provide the necessary biasing force to keep the tool disengaged from the shell to allow free rotation of socket 18 before axial pressure is applied and the socket engaged. It will be understood that use of the term spring in the singular will encompass plural members acting together to exert a biasing force.

The socket extension assembly enables the manual finger start to be bypassed and enables the fastener (not shown) to be engaged with the tool from the start. Typically a magnetic bit is used to ensure securing of the fastener. After a fastener is engaged in the socket, socket shell 18 may be turned by hand to start the threaded engagement of the fastener since the socket will be disengaged from the drive and will be free spinning at this point as the spring is keeping the drive of the tool disengaged from the seat. With the fastener lined up with and contacting the threaded hole, the operator will turn the socket stem 20 by hand until a sufficient number of threads have properly engaged. After confirmation of the proper thread engagement, the operator, while continuing to turn the socket may apply enough axial force with the power tool to overcome the spring. Within about a quarter turn, the square drive stem 14 will line up with the square seat 24 inside the socket shell and the two pieces will fully engage to allow torque to be transmitted from the drive to the socket shell and socket stem. The operator will continue to drive the fastener with the power drill or driver until full and proper torque has been achieved. Once the operator stops the power drill or driver and pulls it away from the fastener, the spring will again separate the socket shell and the drive to allow the socket shell to rotate freely relative to the drive and bushing.

The proportions of the socket shell and the internal bushing are adjustable as long as there is sufficient amount of travel of the bushing inside sleeve 26 to enable the spring to bias toward disengagement and allow full engagement of the drive of the tool to the drive seat in the socket shell.

Since the tool and bushing assembly is completely disengaged from the socket shell 18 in a rest position, there is no rotational limit between the bushing and shell. The drive will freely turn until the threads are engaged and ready for power driver upon application of axial pressure to seat the square drive elements together.

The purpose of the device is to reduce process time when hand-starting bolts is required, specifically when fasteners are threaded into aluminum or other soft materials that may cross-thread easily. The device works by allowing the free rotation of the socket-end of the device in its natural state.

While the illustrated embodiments show a spring as the biasing member, it is understood that other types of elements may be used to bias the bushing and tool in a disengaged state with respect to the socket shell such as a compressible material, a recovery material or the like. In addition, while the illustrated embodiments show a shaft, the male drive end, with a mating aperture, the female drive seat, as the locking assembly, it will be understood that other types of locking assemblies may be employed between the tool and socket shell upon application of axial force to engage the two pieces and transmit rotation drive from the drive stem to the tool bit. For example, as described above, the male element may be part of the socket shell mating to a female element provided on the tool. Other types of locking assemblies such as mating teeth, rabbets, or splines on the mating surfaces of the tool and socket shell may be employed to lockingly engage the tool to the socket shell upon exertion of axial force. Any mating geometrical relationship is possible to ensure that once they are engaged and locked, the tool and socket shell become integrated and rotate together as one unit to drive the fastener. Such mating surfaces or portions include the illustrated drive shaft mated to the drive seat.

In most instances in the description, a fastener is described as being driven into the work piece. It is understood that both tightening or loosening actions of the fastener are contemplated, and encompassed in the description.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The invention claimed is:

1. A socket extension assembly comprising:

a socket shell having a socket stem on one end and defining an inner sleeve having an opposite open end, said sleeve including a drive seat formed therein;

a drive having a drive bit at one end adapted to engage a power tool, and a drive stem at an opposing end, said drive stem configured to mate with said drive seat;

a connector fixedly attached to said drive and rotatably received in said sleeve of said socket shell, said connector maintaining said drive and said shell in axial alignment and having a length shorter than the length of said sleeve; and a biasing member received in said sleeve and disposed between said connector and said drive stem, said biasing member maintaining disengagement of said drive stem and said drive seat until sufficient axial force is applied therebetween.

2. The socket extension assembly of claim 1, wherein said connector and said drive are independently rotatable with respect to said socket shell when said biasing member is in its natural state.

3. The socket extension assembly of claim 2, wherein said connector comprises a cylindrical bushing with a bearing at each open end to fixedly attach said drive to said bushing.

4. The socket extension assembly of claim 3, wherein said biasing member is a wave spring disposed between said internal shoulder and said bushing.

5. The socket extension assembly of claim 3, wherein said connector also comprises a retaining ring retaining each said bearing.

6. The socket extension assembly of claim 2, wherein said socket shell comprises an internal shoulder on which said biasing member impinges.

7. The socket extension assembly of claim 6, wherein said connector comprises a cylindrical bushing with a bearing at each open end to fixedly attach said drive to said bushing.

8. The socket extension assembly of claim 7, wherein said biasing member is a wave spring disposed between said internal shoulder and said bushing, and having a natural state of keeping said drive stem disengaged from said drive seat.

9. The socket extension assembly of claim 1, wherein said socket shell further comprises a retaining structure disposed at its open end that surrounds the drive and maintains axial alignment of said drive, said connector and said socket shell.

10. The socket extension assembly of claim 9, wherein said retaining structure comprises an annular recess in said socket shell receiving a retaining clip therein.

11. A socket extension assembly for selective engagement of a socket to a bit driven by a power drive, said assembly comprising:

a drive having a bit at one end adapted to engage the power drive and a drive stem at an opposing end;

a cylindrical connector fixedly attached to said drive and holding said drive in axial alignment, said connector placed along said drive such that both said bit and said drive stem are exposed;

a socket shell having a socket stem on one end adapted to engage a socket and fastener and defining an inner sleeve having an opposite open end, said sleeve including a drive seat formed therein, said shell receiving said connector therein to maintain axial alignment of said drive, said connector and said shell, said connector having a length shorter than the length of said sleeve between said drive seat and open end, said drive stem configured to be matingly received in said drive seat;

a biasing member disposed within said sleeve between said drive seat and said connector to bias said drive stem to be disengaged from said drive seat in a natural state in which said drive rotates independently of said shell;

wherein said biasing member compresses sufficiently upon application of axial pressure to lockingly engage said drive stem in said drive seat in which said drive and said shell are locked together to transmit rotational force from said bit to said socket stem.

12. The socket extension assembly of claim 11, wherein said connector comprises a cylindrical bushing with a bearing at each open end to fixedly attach said drive to said bushing.

13. The socket extension assembly of claim 11, wherein said socket shell comprises an internal shoulder on which said biasing member impinges.

14. The socket extension assembly of claim 13, wherein said biasing member is a wave spring disposed between said internal shoulder and said bushing, and having a natural state of keeping said drive stem disengaged from said drive seat.

15. The socket extension assembly of claim 11, wherein said socket shell further comprises a retaining structure disposed at its open end that surrounds the drive and maintains axial alignment of said drive, said connector and said socket shell.

16. The socket extension assembly of claim 15, wherein said retaining structure comprises an annular recess in said socket shell receiving a retaining clip therein.

17. A socket extension assembly for selective engagement of a socket stem to a bit driven by a power drive, said assembly comprising:

a drive having a bit at one end adapted to engage a power drive, and a first mating element at an opposing end;

a cylindrical connector fixedly attached to said drive and holding said drive in axial alignment, said connector placed along said drive such that both said bit and said first mating element are exposed;

a socket shell having a socket stem on one end adapted to engage a socket and defining an inner sleeve having an opposite open end, said sleeve including a second mating element formed therein, said shell receiving said connector therein to maintain axial alignment of said drive, said connector and said shell, said connector having a length shorter than the length of said sleeve between said second mating element and open end, a biasing member disposed within said sleeve between said second mating element and said connector to bias said first mating element to be disengaged from said second mating element in a natural state in which said shell rotates independently of said drive;

wherein said biasing member compresses sufficiently upon application of axial pressure to lockingly engage said first mating element said second mating element in which said drive and said shell are locked together to transmit rotational force from said bit to said socket stem.

18. The socket extension assembly of claim 17, wherein said first mating element is a drive stem.

19. The socket extension assembly of claim 17, wherein said second mating element is a drive seat.

20. The socket extension assembly of claim 17, wherein said biasing member is a spring disposed between an internal shoulder of said shell and said connector.

* * * * *